US009192540B1

(12) United States Patent
Tsai

(10) Patent No.: US 9,192,540 B1
(45) Date of Patent: Nov. 24, 2015

(54) ELECTRIC INVERSION TABLE

(71) Applicant: Jui-An Tsai, Taoyuan (TW)

(72) Inventor: Jui-An Tsai, Taoyuan (TW)

( * ) Notice: Subject to any disclaimer, the term of this patent is extended or adjusted under 35 U.S.C. 154(b) by 0 days.

(21) Appl. No.: 14/453,011

(22) Filed: Aug. 6, 2014

(51) Int. Cl.
*A63B 26/00* (2006.01)
*A61H 1/02* (2006.01)

(52) U.S. Cl.
CPC ..... *A61H 1/02* (2013.01); *A61H 2203/0493* (2013.01); *A63B 26/00* (2013.01)

(58) Field of Classification Search
CPC ..... A61H 1/02; A61H 2203/0493; A63B 21/0005; A63B 21/00054; A63B 2208/0285; A63B 2208/029; A63B 26/00; A47B 2200/0035; A47B 2200/0043; A61G 7/005
USPC ..... 482/142, 144, 145
See application file for complete search history.

(56) References Cited

U.S. PATENT DOCUMENTS 3,997,926 A * 12/1976 England ..... A61G 7/005 5/610
4,672,697 A * 6/1987 Schurch ..... A47C 19/045 482/144
7,374,521 B2 * 5/2008 Wang ..... A61H 1/0218 482/144
7,544,157 B2 * 6/2009 Teeter ..... A61H 1/0218 482/144
7,625,327 B1 * 12/2009 Teeter ..... A61H 1/0218 482/144
8,291,533 B2 * 10/2012 Teeter ..... A61H 1/0218 5/11
8,480,543 B1 7/2013 Leier et al.
8,556,787 B2 10/2013 Leier et al.
2004/0157714 A1 * 8/2004 Huang ..... A61H 1/0218 482/144
2006/0046915 A1 * 3/2006 Huang ..... A61H 1/0218 482/145
2007/0032358 A1 * 2/2007 Chen ..... A61H 1/0218 482/144
2013/0150219 A1 * 6/2013 Chang ..... A61H 1/0229 482/144

* cited by examiner

*Primary Examiner* — Oren Ginsberg
*Assistant Examiner* — Gregory Winter
(74) *Attorney, Agent, or Firm* — Muncy, Geissler, Olds & Lowe, P.C.

(57) ABSTRACT

An electric inversion table includes a base, a bench and a driving device. The bench is disposed on the base and is rotated between a horizontal position and a vertical position. The driving device connects the bench to the base for driving the bench to rotate between the horizontal position and the vertical position. When power failure occurs or a motor of the driving device is out of order, users can release locked status by a clutch of the driving device so as to turn the bench from the vertical position back to the horizontal position safely by the body weight.

10 Claims, 7 Drawing Sheets

ELECTRIC INVERSION TABLE

BACKGROUND OF THE INVENTION

The present invention relates to an electric inversion table, especially to an electric inversion table in which a user can rotate from an inverted position to a horizontal position by body weight when the power is gone.

By flipping the body over, people inversion has a plurality of therapeutic benefits including increased blood circulation, improved body flexibility, enhanced immunity, reducing pain in scoliosis, stretch muscles, etc. For people doing exercise or rehabilitation patients, they can be in an inverted position with the help of an inversion table. However, negative effects and potential dangers are also associated with inversion therapy so that people are unable to hang upside down for a long period of time.

There are multiple kinds of inversion tables available on the market such as those revealed in U.S. Pat. No. 8,480,543 and U.S. Pat. No. 8,556,787. Users can hang upside down and turn back by their moving hands moving vertically to operate a board or a bench of the inversion table. The inversion table requires no external power source. Another kind of inversion table includes a power driving device for driving the board or the bench to move to an inverted position and turn back. This is an electric inversion table that is more convenient to use and power-saving. Yet while the electric inversion table is in use and tilted partially, the user together with the electric inversion table is in the inverted position and unable to come back to the upright position once a power supply is out of order such as power failure or the driver's disorder. Without help from others, the user is unable to get out of the inversion table safely by himself. Thus the risk of using the electric inversion table is increased and this causes less popularity of the electric inversion table.

SUMMARY OF THE INVENTION

Therefore it is a primary object of the present invention to provide an electric inversion table with high safety, high stability and long service life.

In order to achieve the above object, an electric inversion table of the present invention includes a base, a bench and a driving device. While in use, the base is stably set on a plane (such as ground or floor). A pivot hole is disposed on a top end of the base and a support seat is disposed on a bottom surface of the bench. The support frame is arranged with a pivot hole corresponding to the pivot hole of the base. The bench and the base are pivotally connected by a pivot shaft passed through the two pivot holes. Thus the bench is rotated between a horizontal position and a vertical position relative to the base. A receiving surface which users can lean on at an inverted angle is arranged at a top surface of the bench. The driving device connects the bench to the base for driving the bench to rotate between the horizontal position and the vertical position relative to the base.

The driving device consists of a motor, at least one gear, a clutch and a pull member. The motor is set at the base while the gear is connected to the motor to be driven to rotate by the motor. One side of the gear is projecting to form a gear shaft that is corresponding to the pivot hole of the support seat and the pivot hole of the base to be connected to and fixed by the pivot shaft. The clutch is arranged between the support seat of the bench and the gear. The clutch includes a hole arranged axially and penetrating thereof so as to be movably arranged at an outer side of the gear shaft of the gear and moved along the longitudinal direction of the gear shaft. The clutch further includes a first end portion at one end and a second end portion at the opposite end. The first end portion is disposed with at least one projection axially while the support seat of the bench is arranged with at least one slot corresponding to and locked with the projection. The second end portion of the clutch is set with a neck portion whose diameter is smaller than that of the first end portion. A spring is mounted at an outer side of the neck portion while two ends of the spring are elastically against the first end portion of the clutch and the gear respectively. The gear and the support seat of the bench are connected elastically by the projection of the clutch and the slot of the bench locked with each other and passed through the spring. Thus the clutch is rotated along with the gear. As to the pull member, it is movably passed through the through holes of the gear. The pull member includes a fixing end fixed at the first end portion of the clutch and an operation end arranged opposite to the fixing end. The operation end is located at an outer side of the end of the gear without the gear shaft and used for users to pull. Thus the clutch is driven to move synchronously by the pull member the user pulled.

When the projection of the clutch is mounted in the slot of the bench, the motor drives the gear and the clutch to rotate, and further drives the bench to rotate between the horizontal position and the vertical position.

While the projection of the clutch and the slot of the bench are separated from each other, the bench is unable to be driven by the motor through the rotation of the gear and the clutch.

When the bench is at the vertical position and the power is off or the driving motor fails, the user can pull the operation end of the pull member outward to drive the clutch moving outward, toward the gear. Thus the projection of the clutch and the slot of the support seat of the bench are separated from each other and the spring is compressed. Now the user can drive the bench to move from the vertical position to the horizontal position by the body weight and then release the pull member. The projection of the clutch is locked into the slot of the support seat of the bench again by the elastic recovery force of the spring.

DETAILED DESCRIPTION OF THE PREFERRED EMBODIMENTS

Figure 1:
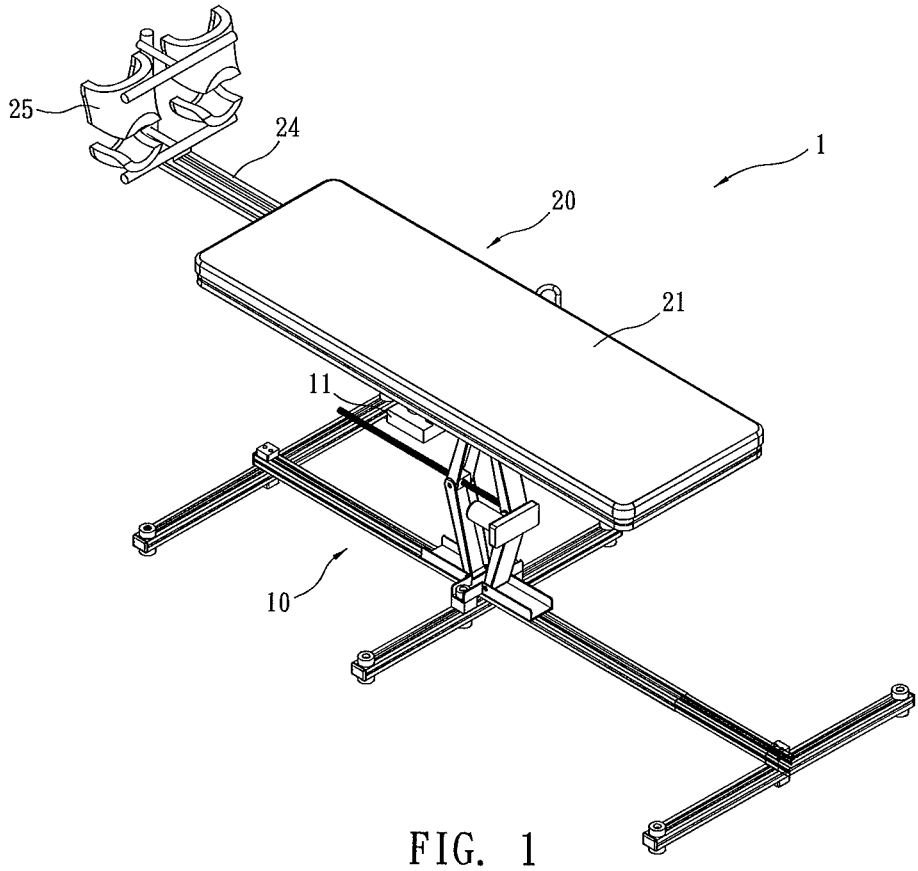
FIG. 1 is a perspective view of an embodiment according to the present invention.
Figure 2:
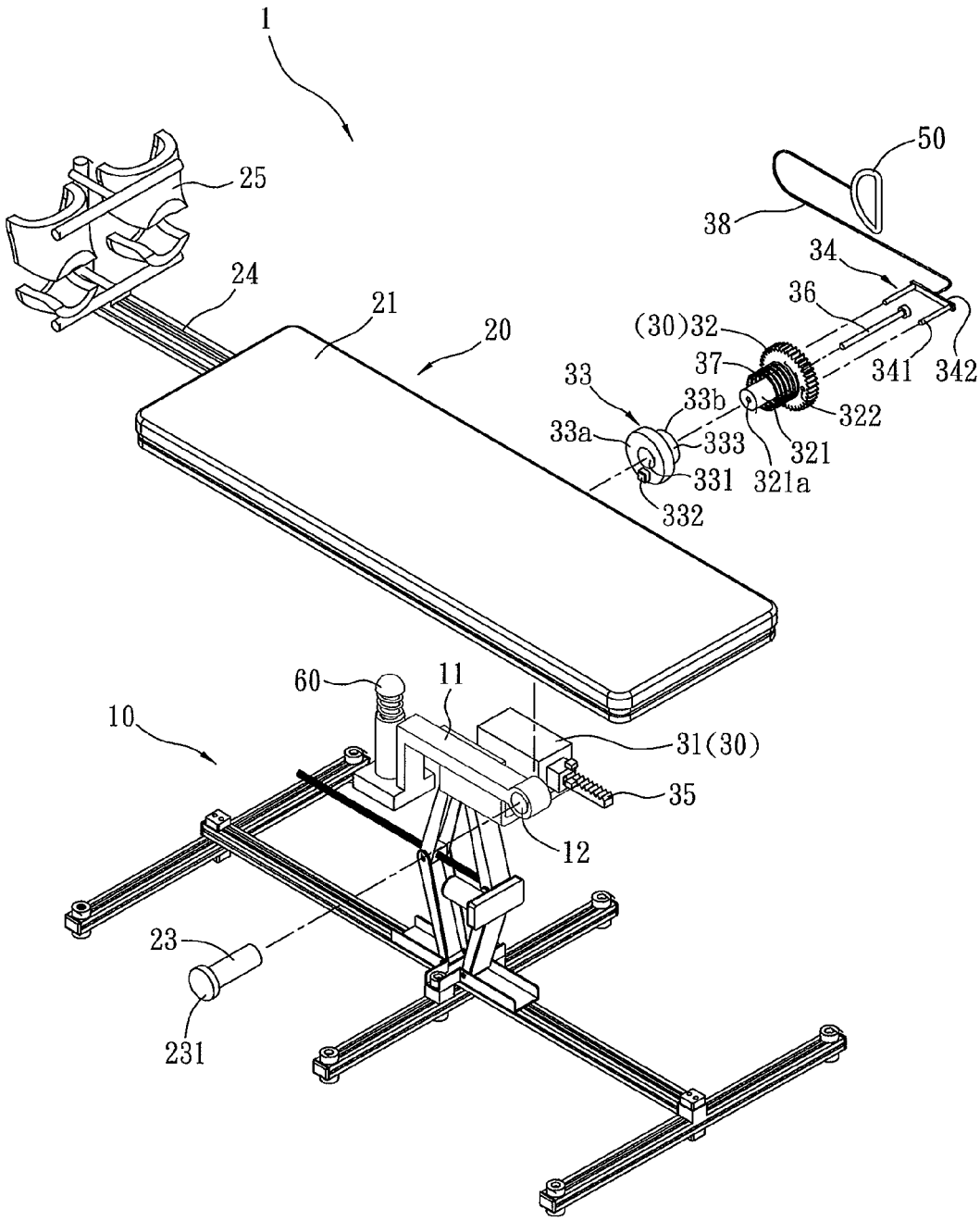
FIG. 2 is an explosive view of the embodiment in FIG. 1 according to the present invention.

Refer to FIG. 1 and FIG. 2, an electric inversion table 1 of the present invention includes a base 10, a bench 20 and a driving device 30. While in use, the base 10 is stably set on a plane (ground or floor is preferred). A support frame 11 is disposed on a top end of the base 10 and the support frame 11 is arranged with a pivot hole 12.

Figure 8:
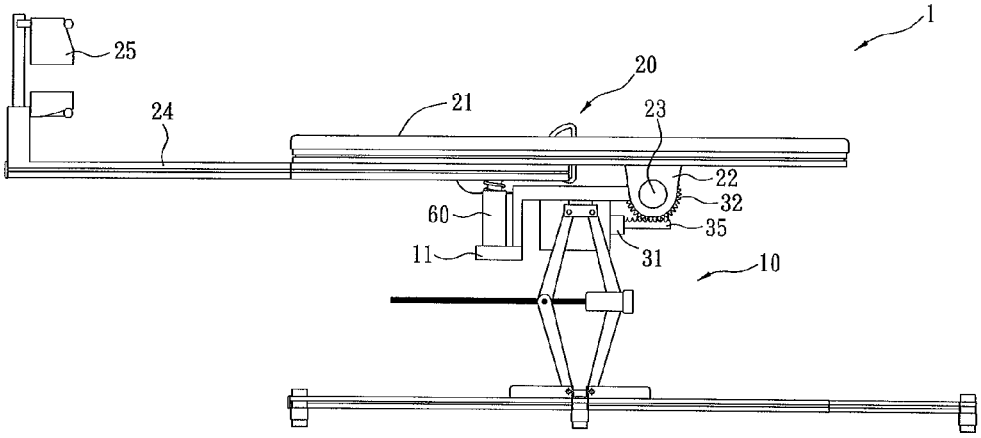
FIG. 8 is a schematic drawing showing an embodiment of the present invention is at a horizontal position.
Figure 9:
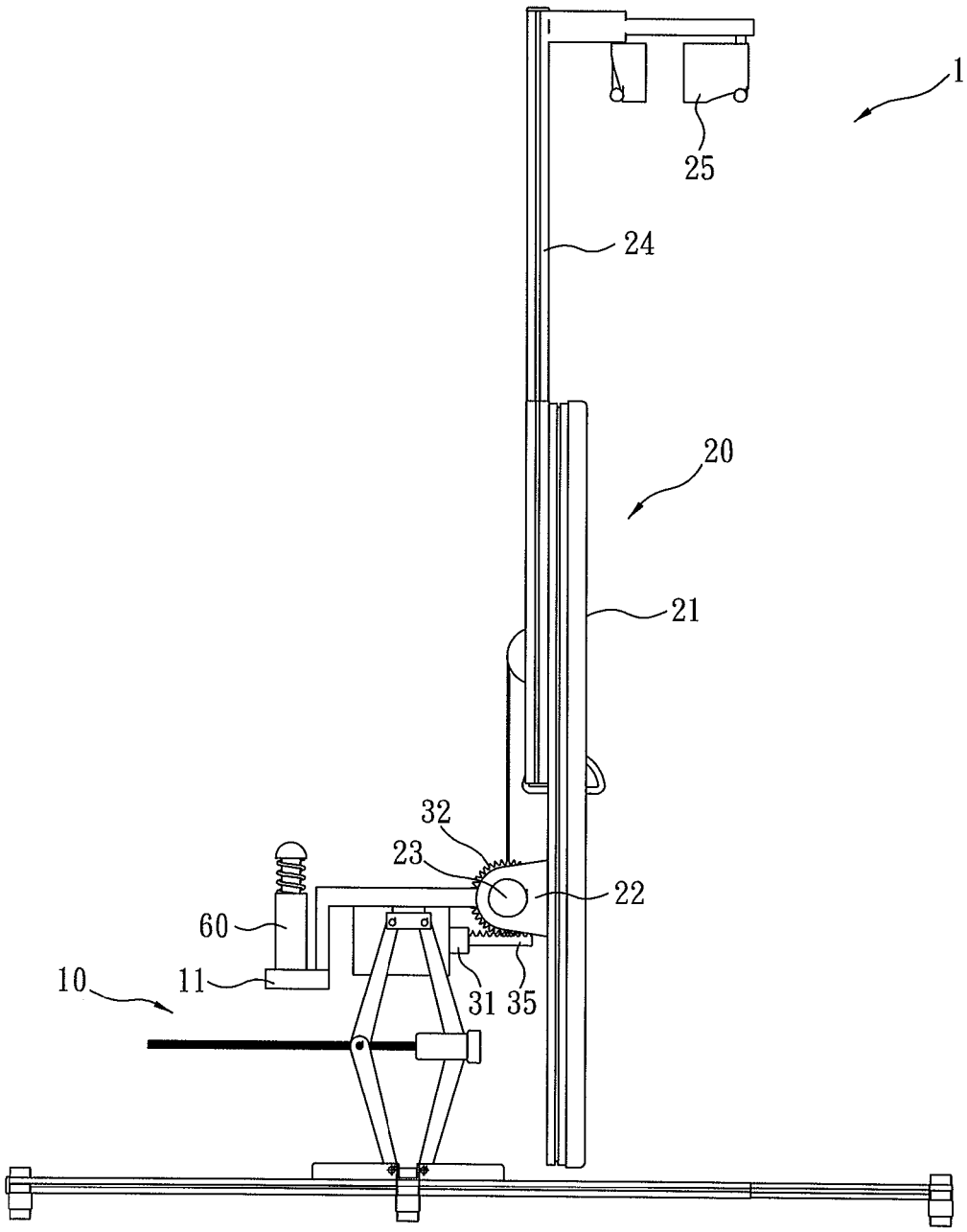
FIG. 9 is a schematic drawing showing an embodiment of the present invention is at a vertical position.

The bench 20 is rotatably disposed on the base 10. A receiving surface 21 which users can lean on at an inverted angle is arranged at a top surface of the bench 20 while a support seat 22 is set on a bottom surface of the bench 20. The support seat 22 includes at least one pivot hole 221 that is corresponding to the pivot hole 12 of the base 10. A pivot shaft 23 is passed through the pivot hole 221 of the support seat 22 and the pivot hole 12 of the base 10 so as to pivotally connect the bench 20 and the base 10. Thus the bench 20 can rotate between a horizontal position (as shown in FIG. 8) and a vertical position (as shown in FIG. 9) relative to the base 10. The bottom surface of the bench 20 is further arranged with a straight frame 24 while a fixing member 25 is set on one end of the straight frame 24 and used for fixing users' feet so as to make the user lean on the bench 20 and hang upside down.

The driving device 30 connects the bench 20 to the base 10 for driving the bench 20 to rotate between the horizontal position and the vertical position relative to the base 10. The driving device 30 consists of a motor 31, at least one gear 32, a clutch 33 and a pull member 34.

Figure 3:
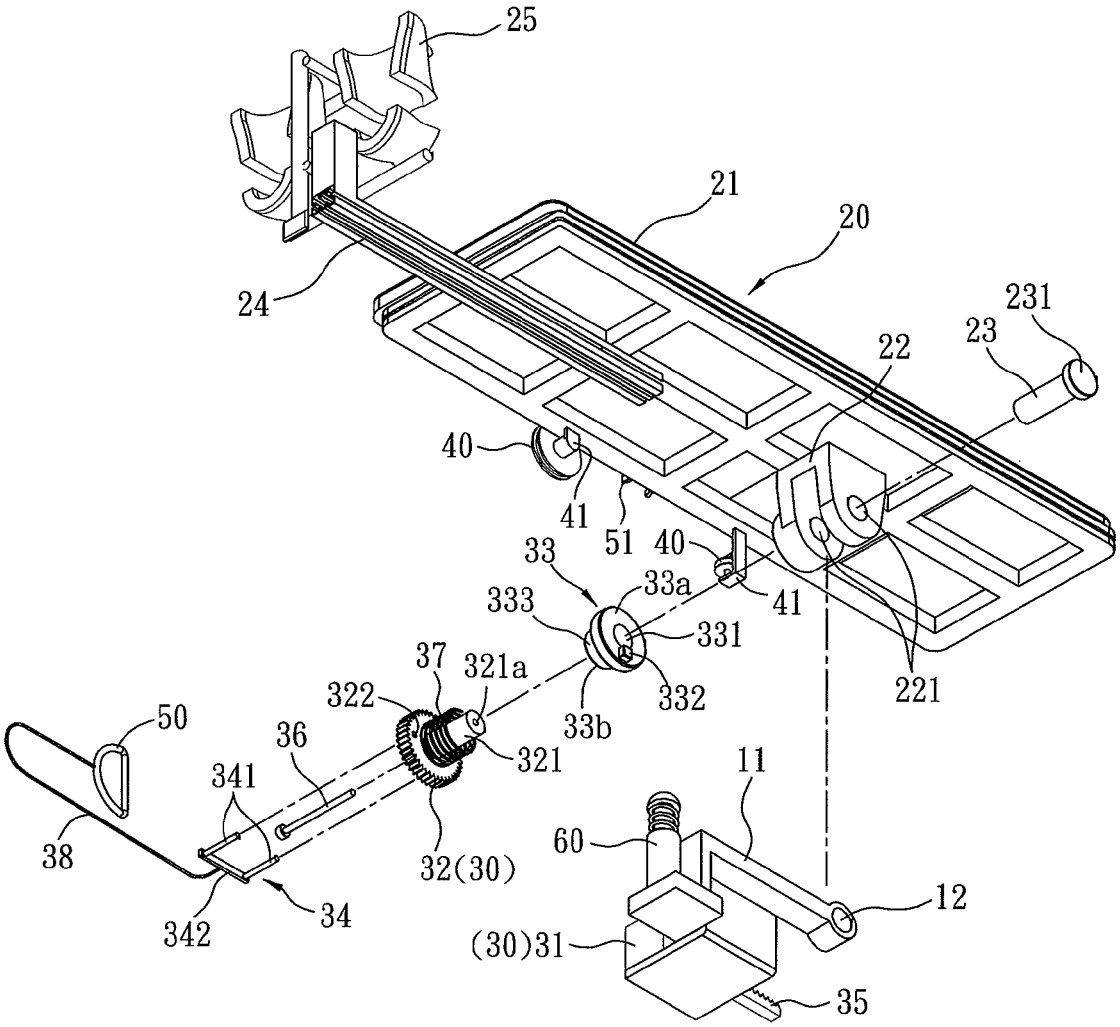
FIG. 3 is a partial explosive view viewed from a bottom side of the embodiment in FIG. 1 according to the present invention.
Figure 4:
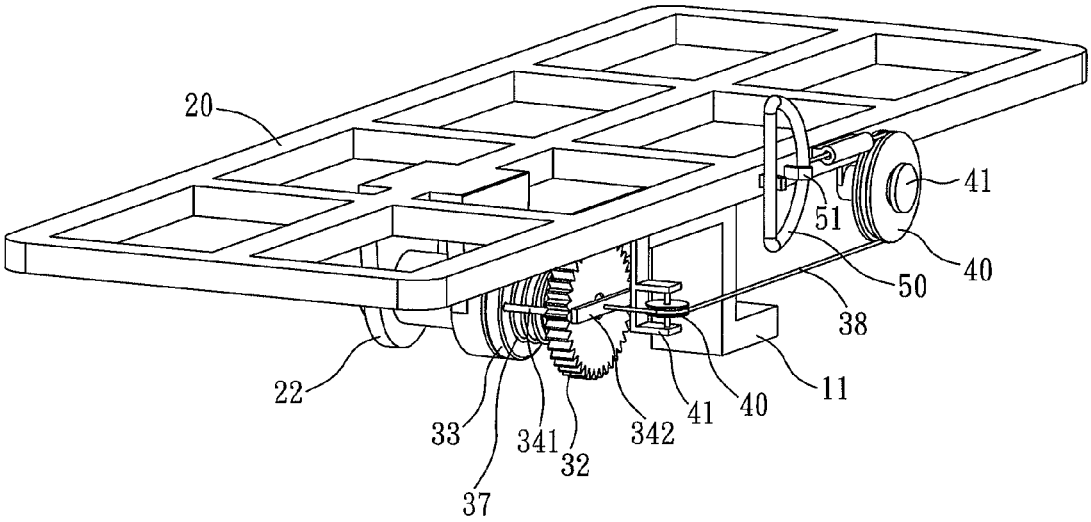
FIG. 4 is a partial enlarged view viewed from a rear side of the embodiment in FIG. 1 according to the present invention.

As shown in FIG. 3, the motor 31 is installed at the support frame 11 of the base 10. The gear 32 is connected to the motor 31 for being driven to rotate by the motor 31. One side of the gear 32 is projecting to form a gear shaft 321. The gear shaft 321 is corresponding to the pivot hole 221 of the support seat 22 and the pivot hole 12 of the base 10 to be connected to and fixed by the pivot shaft 23. A rack 35 is disposed between the gear 32 and the motor 31 to be linked with the gear 32 and the motor 31. One end of the rack 35 is connected to the motor 31 for being driven to move linearly and reciprocally while the other end of the rack 35 is engaged with the gear 32. When the motor 31 drives the rack 35 to move straight, the gear 32 is driven to rotate by the rack 35. The gear 32 and the gear shaft 321 can be integrated into one part or two separated parts fastened with each other. For example, the gear 32 and the gear shaft 321 are disposed with a tapped hole 32*a*, 321*a* respectively and correspondingly. Thus the gear 32 and the gear shaft 321 are connected and integrated by a locking screw 36 passing through the tapped hole 32*a* of the gear 32 and the tapped hole 321*a* of the gear shaft 321. Moreover, the pivot shaft 23 is set with a tapped hole 23*a* corresponding to and communicating with the tapped hole 32*a* of the gear 32 and the tapped hole 321*a* of the gear shaft 321. Thus the locking screw 36 is further passed through the tapped hole 32*a* of the gear 32, the tapped hole 321*a* of the gear shaft 321, and the tapped hole 23*a* of the pivot shaft 23 so as to fasten the gear 32, the gear shaft 321, and the pivot shaft 23 into one part.

Figure 5:
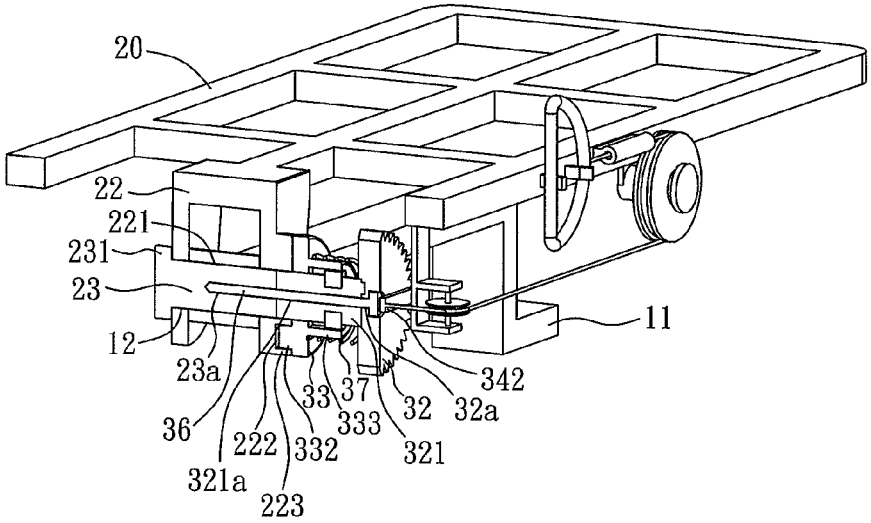
FIG. 5 is a vertical cross section of the embodiment in FIG. 4 according to the present invention.

The clutch 33 is disposed between the support seat 22 of the bench 20 and the gear 32. The clutch 33 includes a hole 331 arranged axially and penetrating thereof, a first end portion 33*a* at one end and a second end portion 33*b* at the opposite end thereof. Thus the clutch 33 is movably connected to an outer side of the gear shaft 321 of the gear 32 and able to be moved along the longitudinal direction of the gear shaft 321. The first end portion 33*a* is facing the support seat 22 of the bench 20 while the second end portion 33*b* is facing the gear 32. The first end portion 33*a* is disposed with at least one projection 332 axially and the support seat 22 of the bench 20 is arranged with at least one slot 222 corresponding to and locked with the projection 332, as shown in FIG. 5. A neck portion 333 whose diameter is smaller than that of the first end portion 33*a* is formed on the second end portion 33*b* of the clutch 33. A spring 37 is mounted at an outer side of the neck portion 333 while two ends of the spring 37 are elastically against the first end portion 33*a* of the clutch 33 and the side surface of the gear 32 respectively. The gear 32 and the support seat 22 of the bench 20 are connected elastically by the projection 332 of the clutch 33 and the slot 222 of the bench 20 locked with each other and passed through the spring 37. Thus the clutch 33 is rotated along with the gear 32. Moreover, the shape of the projection 332 of the clutch 33 is consistent with the shape of the slot 222 of the bench 20. In order to improve structural strength of the projection 332 of the clutch 33 locked with the slot 222 of the bench 20, a projection portion 223 is formed on the support seat 22 in relative to the clutch 33 and the slot 222 is formed on the projection portion 223.

The pull member 34 includes a fixing end 341 at one end thereof and an operation end 342 arranged opposite to the fixing end 341. The fixing end 341 is formed by extension of at least two bars while the gear 32 has at least two through holes 322 corresponding to the bars at the fixing end 341 of the pull member 34. The bars at the fixing end 341 are movably passed through the through holes 322 of the gear 32 to be fixed on and connected to the first end portion 33*a* of the clutch 33. The operation end 342 is located at an outer side of the end of the gear 32 without the gear shaft 321 and used for users to pull. Once the pull member 34 is pulled and moved by a user, the clutch is driven to move synchronously.

Figure 6:
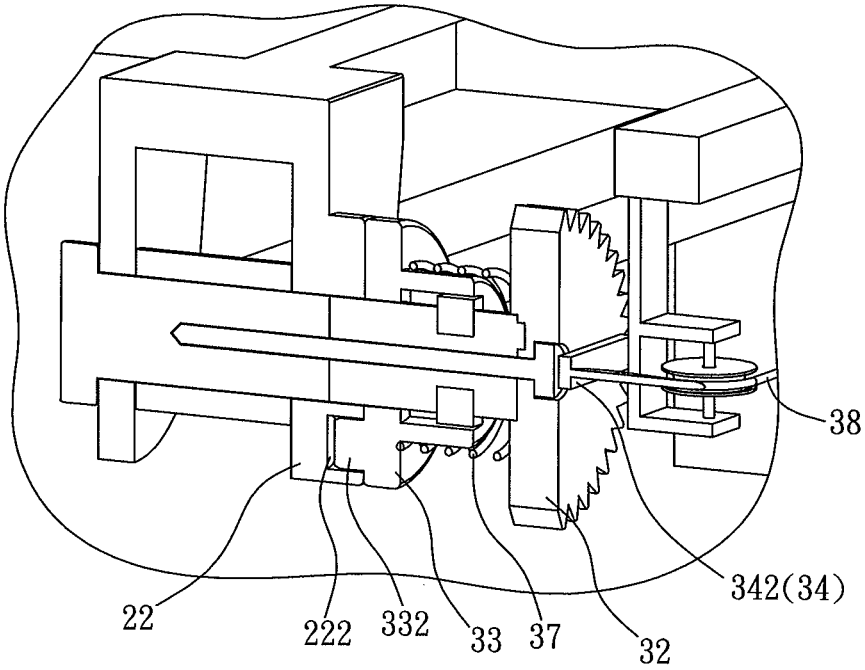
FIG. 6 is a schematic drawing showing a projection of a clutch and a slot of a support seat of a bench locked with each other in an embodiment of the present invention.

Refer to FIG. 6, when the projection 332 of the clutch 33 is engaged with the slot 222 of the support seat 22 of the bench 20, the motor 31 drives the gear 32 and the clutch to rotate, and further drives the bench 20 to rotate between the horizontal position and the vertical position.

Figure 7:
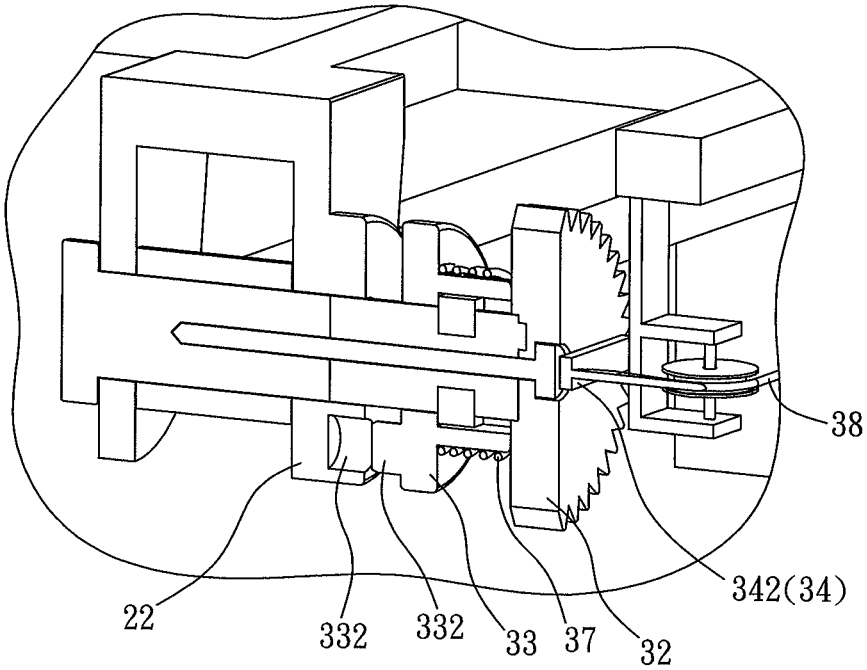
FIG. 7 is a schematic drawing showing a projection of a clutch and a slot of a support seat of a bench separated from each other in an embodiment of the present invention.

Refer to FIG. 7, while the projection 332 of the clutch 33 is released from the slot 222 of the support seat 22 of the bench 20, the bench 20 is unable to be driven by the motor 1 through the rotation of the gear 32 and the clutch 33.

As shown in FIG. 3, the driving device 30 further includes a rope 38 having one end thereof to connect to the operation end 342 of the pull member 34 while the other end of the rope 38 is wound around at least one pulley 40 and disposed with a ring 50 which users can grasp. The pulley 40 is set on a pulley support 41 which is fixed on the bench 20. Moreover, the ring 50 can be hung on a hook 51 that is arranged at the bench 20. Thereby the user can hold the ring 50 so as to pull the pull member 34 and the clutch 33 to move through the rope 38.

One end of the pivot shaft 23 opposite to the end of the pivot shaft 23 connected to the gear shaft 321 of the gear 32 of the driving device 30 is projecting from the pivot hole 221 of the support seat 22 and is disposed with a stopping portion 231. The diameter of the stopping portion 231 is larger than that of the pivot hole 221 so that the stopping portion 231 is stopped outside the pivot hole 221 to prevent the pivot shaft 23, the gear 32 and the gear shaft 321 from moving and hold them in place.

As shown in FIG. 2, the present invention further includes a buffer 60 arranged between the base 10 and the bench 20, and fixed on the support frame 11 of the base 10. When the bench 20 is rotated from the vertical position to the horizontal position, the buffer 60 is in contact with the bottom surface of the bench 20 to prevent the bench 20 from rotating over the normal range. That means the bench 20 is maintained at the horizontal position after it being in contact with the buffer 60.

When the bench 20 is located at the vertical position while the power is gone or the driving motor fails, the user can pull the operation end 342 of the pull member 34 outward to drive the clutch 33 moving outward, toward the gear 32. Thus the projection 332 of the clutch 33 and the slot 222 of the support seat 22 of the bench 20 are separated from each other and the spring 37 is compressed. Now the user can drive the bench 20 to move from the vertical position to the horizontal position by the body weight. Then the pull member 34 is released and the clutch 33 is moved inward by the elastic recovery force of the spring 37. The projection 332 of the clutch 33 is locked into the slot 222 of the support seat 22 of the bench 20 again.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electric inversion table comprising:

a base having a pivot hole at a top end thereof;

a bench having a support seat disposed on a bottom surface thereof and a receiving surface which a user leans on at an inverted angle arranged at a top surface thereof; the support seat includes at least one pivot hole that is corresponding to the pivot hole of the base; a pivot shaft is passed through the pivot hole of the support seat of the bench and the pivot hole of the base so as to pivotally connect the bench and the base; thus the bench is able to rotate between a horizontal position and a vertical position relative to the base;

a driving device that connects the bench to the base for driving the bench to rotate between the horizontal position and the vertical position relative to the base; the driving device having:

a motor that is installed at the base;

at least one gear that is connected to the motor to be driven to rotate by the motor and having one side thereof projecting to form a gear shaft; the gear shaft is corresponding to the pivot hole of the support seat, connected to and fixed by the pivot shaft;

a clutch that is disposed between the support seat of the bench and the gear; the clutch having a hole arranged axially and penetrating thereof for being movably connected to an outer side of the gear shaft of the gear and moved along a longitudinal direction of the gear shaft; a first end portion is disposed on one end of the clutch and a second end portion is arranged opposite to the first end portion; the first end portion is disposed with at least one projection axially while the support seat of the bench is arranged with at least one slot corresponding to and lockable with the projection of the clutch; a neck portion whose diameter is smaller than a diameter of the first end portion is formed on the second end portion of the clutch and a spring is mounted at an outer side of the neck portion while two ends of the spring are elastically against the first end portion of the clutch and the gear respectively; and a pull member moveably passed through through holes of the gear correspondingly and having a fixing end at one end thereof and an operation end arranged opposite to the fixing end; the fixing end is fixed on the first end portion of the clutch; the operation end is located at an outer side of an end of the gear without the gear shaft and used for the user to pull for driving the clutch to move synchronously;

wherein the clutch is driven to rotate by the gear through the pull member and the bench is rotated with the clutch by the projection of the clutch locked with the slot of the support seat of the bench;

wherein the motor drives the gear and the clutch to rotate, and further drives the bench to rotate between the horizontal position and the vertical position when the projection of the clutch is mounted in the slot of the bench;

wherein the bench is unable to be driven by the motor through the rotation of the gear and the clutch while the projection of the clutch and the slot of the bench are separated from each other;

wherein the operation end of the pull member is able to be pulled outward by the user to drive the clutch moving outward, toward the gear when the bench is located at the vertical position and power failure occurs or the driving motor fails, causing the projection of the clutch and the slot of the support seat of the bench to separate from each other and the spring to compress, and at this moment the user can drive the bench to move from the vertical position to the horizontal position by body weight and then release the pull member; the projection of the clutch is locked into the slot of the support seat of the bench again by elastic recovery force of the spring.

2. The table as claimed in claim 1, wherein the bottom surface of the bench is further arranged with a straight frame while at least one fixing member is disposed on the straight frame for fixing the user's feet so as to make the user lean on the bench and hang upside down.

3. The table as claimed in claim 1, wherein the driving device further includes a rack disposed arranged between the motor and the gear; one end of the rack is connected to the motor for being driven to move linearly and reciprocally while the other end of the rack is engaged with the gear.

4. The table as claimed in claim 1, wherein the driving device further includes a rope; one end of the rope is connected to the operation end of the pull member while the other end of the rope is wound around at least one pulley and disposed with a ring for the user to grasp; the pulley is set on a pulley support which is fixed on the bench.

5. The table as claimed in claim 4, wherein the bench is arranged with a hook corresponding to the ring and the ring is hung on the hook.

6. The table as claimed in claim 1, wherein one end of the pivot shaft not connected to the gear shaft of the gear is projecting from the pivot hole of the bench and is disposed with a stopping portion; a diameter of the stopping portion is larger than a diameter of the pivot hole of the bench.

7. The table as claimed in claim 1, wherein the gear and the gear shaft of the driving device are two separated parts disposed with a hole respectively and correspondingly so that the gear and the gear shaft are connected and integrated by a locking screw passing through the hole of the gear and the hole of the gear shaft.

8. The table as claimed in claim 7, wherein the pivot shaft is set with a hole correspondingly to and communicating with the hole of the gear and the hole of the gear shaft; thus the locking screw is passed through the hole of the gear, the hole of the gear shaft, and the hole of the pivot shaft so as to fasten the gear, the gear shaft, and the pivot shaft into one part.

9. The table as claimed in claim 1, wherein a projection portion is formed on the support seat of the bench and the slot is formed on the projection portion.

10. The table as claimed in claim 1, wherein the fixing end is formed by extension of at least two bars.

* * * * *